US006253677B1

(12) United States Patent
Switall

(10) Patent No.: US 6,253,677 B1
(45) Date of Patent: Jul. 3, 2001

(54) SPRAY NOZZLE REPOSITIONING DEVICE

(75) Inventor: Thomas G. Switall, Kildeer, IL (US)

(73) Assignee: Ryco Graphic Manufacturing, Inc., Wheeling, IL (US)

( * ) Notice: Subject to any disclaimer, the term of this patent is extended or adjusted under 35 U.S.C. 154(b) by 0 days.

(21) Appl. No.: 09/522,577

(22) Filed: Mar. 10, 2000

Related U.S. Application Data

(60) Provisional application No. 60/123,799, filed on Mar. 10, 1999.

(51) Int. Cl.[7] ..... B41L 25/06
(52) U.S. Cl. ..... 101/147; 101/132.5
(58) Field of Search ..... 101/147, 148, 101/132.5, 363, 364, 365

(56) References Cited

U.S. PATENT DOCUMENTS 4,873,925 * 10/1989 Hultberg et al. ..... 101/147
5,025,722 * 6/1991 Switall et al. ..... 101/147
5,035,176 * 7/1991 Miller et al. ..... 101/148

* cited by examiner

*Primary Examiner*—John S. Hilten
*Assistant Examiner*—Kevin D. Williams
(74) *Attorney, Agent, or Firm*—Lee, Mann, Smith, McWilliams, Sweeney & Ohlson

(57) ABSTRACT

Disclosed is a spray nozzle repositioning device for attaching to a spray bar in a multi-nozzle spray dampening system of a printing press to reposition the nozzle and reduce the area covered by the dampening spray. The positioning device has a fluid conducting body member to which is connected a first coupling member which extends transversely outwardly from the body member and engages the nozzle connector on the spray bar. A second coupling member spaced from the first coupling member is operatively connected to the body member and extends transversely outward in the direction opposite to the first direction and has formations which permit the mounting of the nozzle in fluid communication with the body member so that the nozzle may be repositioned transversely closer to the adjacent nozzle and closer to the surface being sprayed.

3 Claims, 2 Drawing Sheets

Figure 1:
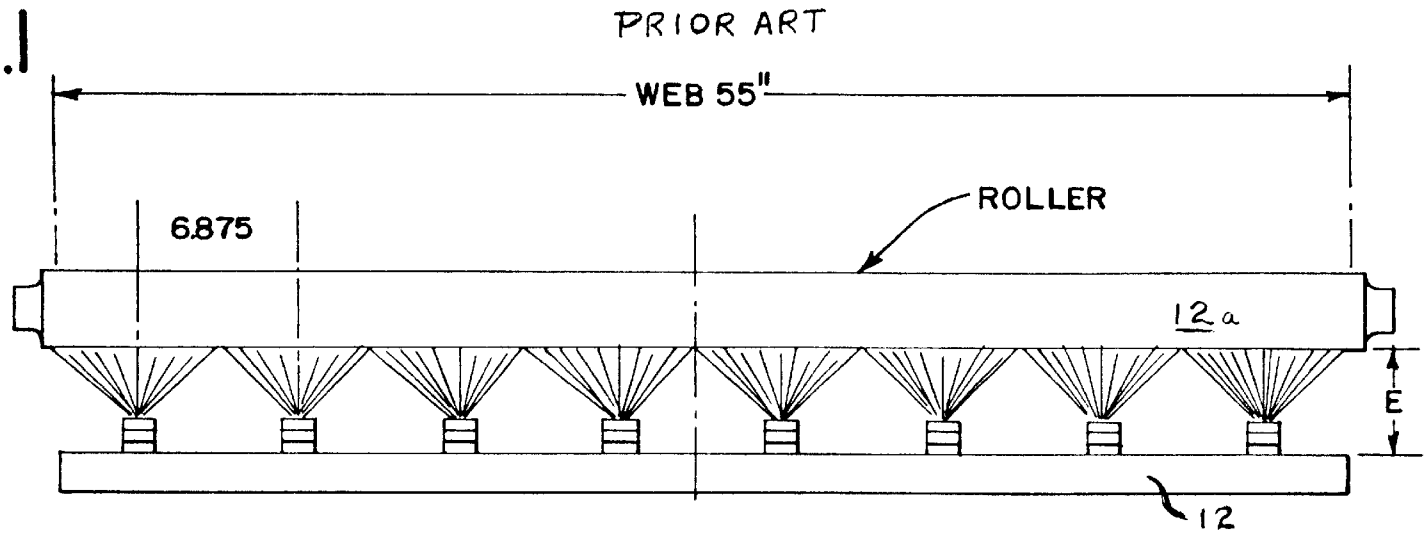

VARIES
9
4
11
3
7
8
6
18
15
14
17
2
13
1
5a
5
10
9a
16
12
10a 1
9
19
5
3
2

SPRAY NOZZLE REPOSITIONING DEVICE

This application claims the priority of provisional application No. 60/123,799 filed Mar. 10, 1999.

BACKGROUND OF THE INVENTION

The invention pertains to a spray nozzle repositioning device for use in a multinozzle spray dampening system for a printing press. The device permits the repositioning of each of the nozzles to reduce the area covered by the dampening spray. Thus, the dampening spray may be adjusted to accommodate different page sizes.

In my U.S. Pat. No. 4,815,375, I disclose a spray dampening system for use in a printing operation. That system employs a spray bar on which are fixedly mounted solenoid operated spray dampening fluid nozzles. The spray nozzle repositioning device of this invention is intended to fit the spray bars and more particularly the nozzle connecting formations such as the solenoid stems extending outwardly from the spray bar to reposition those nozzles.

Heretofore, in order to accommodate different page sizes and thus reduce the area covered by the spray dampening system, it was necessary to totally replace the spray bars and nozzles of the system to match the web size reduction. This is both expensive and time consuming and would result in press shut down for extended periods of time.

The device makes it possible to change the center-to-center distance of the spray nozzles in the spray dampening system of the type shown in my patent U.S. Pat. No. 4,815,375 to accommodate a reduction in the width ofthe paper web being printed. The device avoids the necessity of totally replacing the spray bars and nozzles of the system. The device will permit the repositioning of each of the nozzles to match the web size reduction by moving each nozzle the proper distance in a horizontal plane and also move the nozzle closer to the surface being sprayed. This will not only reduce the size of the area being sprayed but it will avoid excessive overlap of the spray patterns of adjacent nozzles as they impinge upon this surface, which in the usual case is a dampening roller. The device permits the spray bar to remain in its original position relative to the dampening roller in the offset printing press. Thus the spray bar itself does not have to be moved. The changed can be accomplished merely by removing each of the nozzles, inserting the nozzle repositioning device on the spray bar and then connecting the removed nozzle to the nozzle repositioning device.

SUMMARY OF THE INVENTION

The spray nozzle repositioning device of this invention is intended to be used in a spray dampening system for a printing press. The dampening fluid is delivered to a moving surface, such as a dampening roller, of the printing press by nozzles which are connected to the dampening solution conductor, which is preferably a spray bar, in order to spray the dampening fluid in juxtaposed patterns that substantially uniformly cover a predetermined width of the moving surface without substantial pattern overlap. The device attaches to a nozzle connector, which in the usual instance is the externally threaded stem of the spray bar, with each of the several nozzles of the multi-nozzle spray dampening system having its own spray nozzle repositioning device. The device will permit the repositioning of its associated nozzle to reduce the area covered by the dampening spray and to prevent undesirable overlap of the spray patterns.

In accordance with one embodiment of this invention, the nozzle repositioning device includes a body member having a fluid conduit therethrough, a first coupling member operably connected to and extending transversely in a first direction from said body member and a second coupling member operatively connected to and extending transversely outwardly from the body member in a second direction opposite to the first direction. The first coupling member has formations which sealingly engage the dampening fluid conductor and provides fluid communication between the dampening fluid conductor and said body member fluid conduit. The second coupling member has formations which sealingly engage the nozzle and provide fluid communication between the nozzle and the body member fluid conduit. Thus, each nozzle may be located transversely closer to the immediately adjacent nozzle and closer to the moving surface. This narrows the page width covered by the dampening fluid spray without increasing the overlap of the juxtaposed spray patterns.

IN THE DRAWINGS

Figure 2:
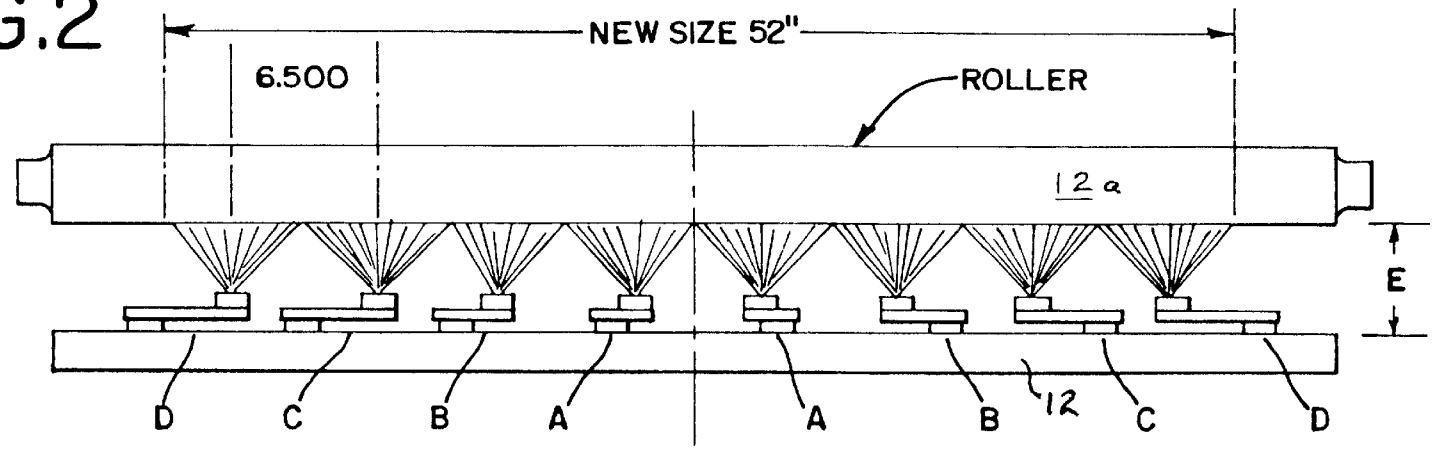
Figure 3:
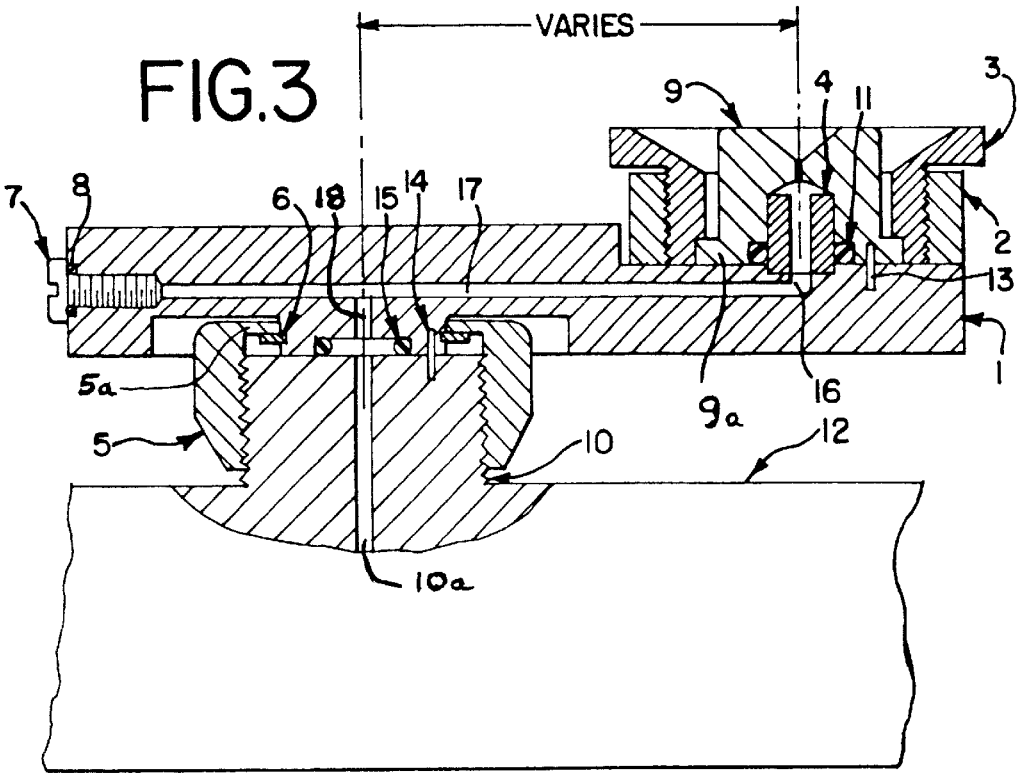
Figure 4:
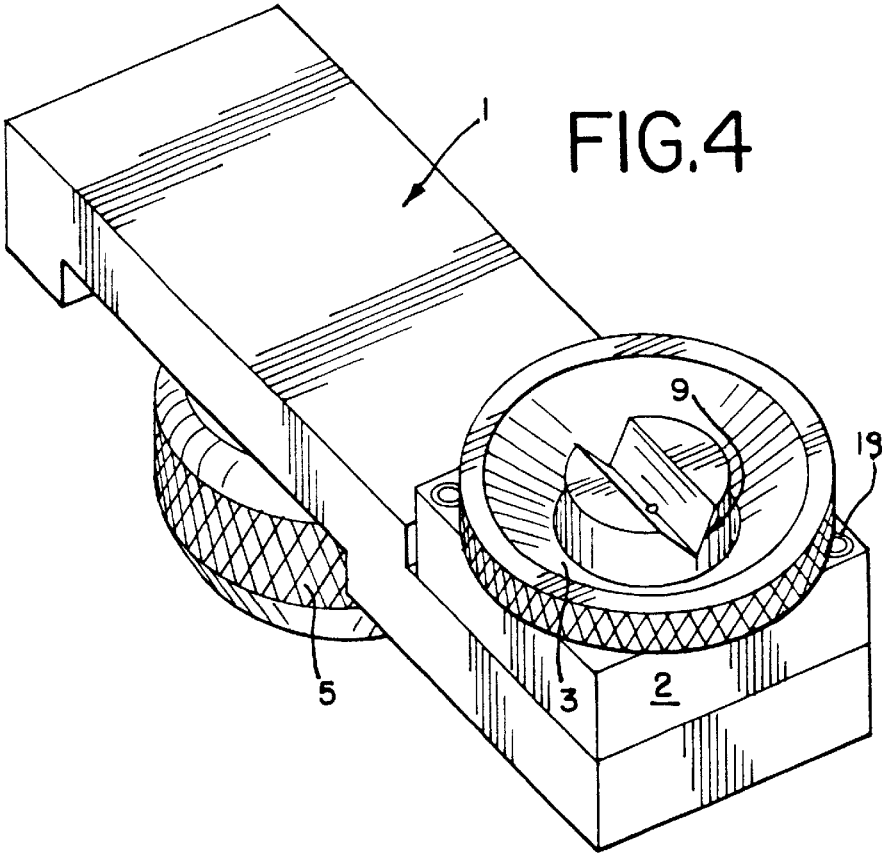

FIG. 1 is a top plan view of a spray dampening system of the prior art used for printing a standard 55" paper web, the moving surface being sprayed being a dampening roller;

FIG. 2 is a top plan view of a spray dampening system incorporating the spray nozzle repositioning device constructed in accordance with this invention, FIG. 3 is an enlarged side elevational view partially in section showing one of the spray nozzle repositioning devices mounted on the externally threaded stem of a spray bar; and FIG. 4 is a perspective view of one of the spray nozzle repositioning devices constructed in accordance with this invention.

DETAILED DESCRIPTION OF THE PREFERRED EMBODIMENT

The spray nozzle repositioning device enables the repositioning of adjacent nozzles in a spray dampening system used in a printing operation. The purpose of the repositioning device is to permit the nozzles to be moved closer to the adjacent nozzles and closer to the moving surface being sprayed to narrow the page width covered by the dampening solution spray without increasing the overlap of the juxtaposed spray patterns. As best shown in FIG. 3, which is a cross-section of the spray nozzle repositioning device 12 which is mounted to the externally threaded stem or nozzle connector 10 of a spray bar 12. The device is adapted to position the nozzle 9 forwardly and laterally from each of the threaded stems 10 of the dampening fluid conductor, which in the illustrated embodiment is the spray bar 12. The normal position for the nozzle 9 is in line with the fluid channel 10*a* extending through the spray bar stem 10, i.e., the passage through which the fluid exits the spray bar. It will be appreciated that the connection to the spray bar could be a standard "quick-connect" or it could even be an internally threaded hole in the spray bar.

The spray nozzle positioning device of the illustrated embodiment has a body member or housing 1 having a fluid conduit or channel 17 extending therethrough. A screw 7 may be screwed into the end of the conduit 17 and sealed with an O-ring seal 8. The screw may be removed for purposes of cleaning the channel 17. A first coupling member is operatively connected to and extends transversely downwardly from the body member 1. In the illustrated embodiment wherein the coupling member is connected to the externally threaded stem 10 of the spray bar, the first coupling member may include a swivel nut 5 which is internally threaded and mates with the externally threaded stem 10 of the spray bar. The swivel nut 5 has an inwardly extending annular shoulder 5*a* and retaining ring 6 is mounted in a grove in the body member 1 below the annular shoulder 5*a* of the swivel nut 5. This mounting ring 6 thus holds the swivel nut in position on the body member 1 which may be correctly aligned with threaded stem 10 by positioning pin 14. An entrance channel 18 in the body member 1 extends transversely with respect to the fluid channel 17 through the body member 1 and is in fluid communication with the fluid channel 17 of that body member. This entrance channel 18 aligns with the fluid channel 10*a* through the threaded stem 10 of the spray bar, and when the swivel nut is tightened down on the stem 10 the O-ring 15 surrounding the end of the entrance channel 18 seals the body member 1 to the stem of the spray bar surrounding the entrance channel 18 and thus provides fluid communication between the dampening fluid conductor or spray bar 12 and the fluid channel 17 of the body member.

Adjacent the opposite end of the transversely extending body member 1 is a second coupling member which is operatively connected to and extends transversely outwardly, i.e., in the direction opposite to that of the first coupling member from the body member. This second coupling member is adapted to hold the original nozzle 9 in its new position as defined by the second coupling member. As shown in FIGS. 3 and 4, the nozzle 9 is mounted in position by a flange knurl nut 3 which is threaded into an internally threaded plate 2 which is attached by screws 19 or other suitable attachment means to the end of the housing or body member 1. The plate 2 surrounds the exit fluid channel 16 which extends transversely outwardly from the substantially horizontally extending fluid channel 17 of the body member. Nozzle 9 is positioned correctly by locating pins 13 which extend through aligned holes in the body member 1 and the nozzle 9. The orifice insert 4 is press fitted into a recess surrounding the exit channel 16 and o-ring 11 preferably surrounds this insert. The nut 3 thus clamps the shoulder 9*a* of the nozzle to the body member 1 and the passage way through the orifice insert 4 aligns with the fluid exit channel 16 to control the fluid stream from the fluid channel 17 through the exit channel 16, the orifice insert 4 and the nozzle 9.

FIGS. 1 and 2 show how the spray pattern from the spray dampening system may be reduced from one which accommodates a paper web 55" in width (FIG. 1) to a spray pattern which accommodates a paper web 52" in width both utilizing the same eight nozzles but with the spray nozzle repositioning device of this invention incorporated with each nozzle to move the nozzle laterally and forwardly toward the surface being sprayed by the dampening system which in this case is a dampening roller 12*a*.

In the original spray bar for a 55" paper web the eight nozzles have a center-to-center spacing of 6.875 inches or ⅛th of 55". By the same token a 52" wide paper web requires a reduction in the center-to-center spacing of the nozzles to 6.5" or ⅛th of 52". FIG. 2 shows the spray nozzle repositioning devices mounted on the dampening spray bar 12 with four different offset dimensions for the four pairs of nozzle repositioning devices. The nozzle repositioning devices reposition the nozzles inwardly toward the center line of the web. The repositioning or offset dimensions are as follows for the web reduction of this example from 55" to 52":

(A) 2 holders, each offset 0.187 in.

(B) 2 holders, each offset 0.562 in.

(C) 2 holders, each offset 0.937 in.

(D) 2 holders, each offset 1.312 in.

With a 55" wide paper web the center-to-center spacing with the nozzles is 6.875". With a 52" wide paper web the center-to-center spacing of the nozzles is 6.5". The difference is 0.375". Thus, by positioning the first two nozzles A each 0.187" toward the center line, the total change is 0.375". Since the next two nozzles B must be positioned 0.375" from the adjacent two nozzles which were moved inwardly a distance of 0.187", this second set of nozzles B must be moved a total of 0.562", which is the sum of 0.375" and 0.187". By the same token the third pairs of nozzles C must be moved inwardly by a total of 0.375" plus 0.562", or a total of 0.937". The fourth set of nozzles D must be moved inwardly by a total of 0.375" plus 0.937", or a total of 1.312".

The spacing E between the spray bar 12 and the dampening roller 12*a* remains the same. However, the spray nozzle positioning device moves the nozzles closer to the roller 12*a* by a distance sufficient to ensure that the spray patterns of adjacent nozzles will meet, but will not excessively overlap at the point of impingement with the roller 12*a*. This prevents over wetting of the dampening roller 12*a* which is undesirable in a spray dampening system.

The foregoing description has been given only by way of example, and it will be apparent that many modifications can be made in the preferred embodiment without departing from the spirit and scope of the invention as hereinafter claimed,

What I claim is:

1. In a spray dampening system for a printing press wherein a dampening fluid is sprayed to a moving surface of a printing operation by a plurality of adjacent spray nozzles which are connected to dampening fluid conductors and positioned to spray the fluid in juxtaposed patterns of a width that substantially uniformly cover a predetermined page width of the moving surface without substantial pattern overlap, a device which adjusts the position of the nozzles relative to one another and to the moving surface to reduce the width of the spray pattern at the moving surface to accommodate a lesser page width without substantial pattern overlap, said device including a plurality of body members each having a fluid conduit therethrough, a first coupling member operatively connected to and extending transversely in a first direction from said body member, said first coupling member having formations which sealingly engage the dampening fluid conductor and provide fluid communication between the dampening fluid conductor and said body member fluid conduit, a second coupling member operatively connected to and extending transversely in a second direction opposite to said first direction from said body member, said second coupling member having formations which sealingly engage a nozzle and provide fluid communication between the nozzle and said body member fluid conduit, each of the plurality of body members being of a different length, whereby the nozzle may be located transversely closer to an adjacent nozzle and closer to the moving surface to narrow the page width covered by the juxtaposed spray patterns without increasing overlap of the juxtaposed spray patterns.

2. In a spray dampening system for a printing press, said system having a spray bar adapted to deliver a dampening fluid to a moving surface of the press, a nozzle repositioning device comprising a plurality of fluid conducting body members each having connector means extending transversely in a first direction from said body member and providing a fluid connection between the spray bar and said body member, and nozzle mounting means spaced from said connector means and extending transversely from said body member in a direction opposite said first direction for holding a nozzle and providing a fluid connection between the nozzle and said body member, each of the plurality of body members being of a different length, whereby the nozzle is repositioned transversely closer to an adjacent nozzle and closer to the moving surface being sprayed to reduce the area of the moving surface being sprayed.

3. A spray nozzle repositioning device for use in a multi-nozzle spray dampening system for a printing press having a dampening surface, which spray dampening system has a spray bar with a plurality of nozzle connectors mounted in fixed position relative to each other, said repositioning device including a plurality of body members each having a fluid conduit therethrough, a first coupling member operatively connected to and extending transversely in a first direction from said body member, said first coupling member having formations which sealingly engage a nozzle connector and provide fluid communication between the nozzle connector and said body member fluid conduit, a second coupling member operatively spaced from said first coupling member and connected to said body member and extending transversely therefrom in a second direction opposite to said first direction, said second coupling member having formations which sealingly engage a nozzle and provide fluid communication between the nozzle and said body member fluid conduit, each of the plurality of body members being of a different length, whereby the nozzle is repositioned transversely closer to an adjacent nozzle and closer to the dampening surface being sprayed to reduce the area of the dampening surface being sprayed.

* * * * *